United States Patent [19]

Hasegawa et al.

[11] 4,152,147

[45] May 1, 1979

[54] BERYLLIUM-CONTAINING IRON-BORON GLASSY MAGNETIC ALLOYS

[75] Inventors: Ryusuke Hasegawa, Morristown; Ranjan Ray, Randolph; Lee E. Tanner, Summit, all of N.J.

[73] Assignee: Allied Chemical Corporation, Morris Township, Morris County, N.J.

[21] Appl. No.: 894,665

[22] Filed: Apr. 10, 1978

[51] Int. Cl.[2] ..... C22C 38/00

[52] U.S. Cl. ..... 75/123 B; 75/123 C

[58] Field of Search ..... 75/123 B, 123 C

[56] References Cited

U.S. PATENT DOCUMENTS

| | | | |
|---|---|---|---|
| 3,856,513 | 12/1974 | Chen et al. | 75/123 B |
| 3,871,836 | 3/1975 | Polk et al. | 75/170 |
| 3,989,517 | 11/1976 | Tanner et al. | 75/175.5 |
| 4,036,638 | 7/1977 | Ray et al. | 148/31.55 |

*Primary Examiner*—Arthur J. Steiner

*Attorney, Agent, or Firm*—Ernest D. Buff; Gerhard H. Fuchs

[57] ABSTRACT

Introduction of beryllium into iron-boron base glassy alloys improves the thermal stability while substantially retaining the saturation moment of the base alloy. The alloys of the invention consist essentially of about 10 to 18 atom percent boron, about 2 to 10 atom percent beryllium and about 72 to 80 atom percent iron plus incidental impurities.

6 Claims, 2 Drawing Figures

BERYLLIUM-CONTAINING IRON-BORON GLASSY MAGNETIC ALLOYS

BACKGROUND OF THE INVENTION

1. Field of the Invention

The invention is concerned with glassy alloys and, more particularly, with beryllium additions to iron-boron glassy alloys.

2. Description of the Prior Art

Binary iron-boron glassy alloys consisting of about 15 to 25 atom percent boron, balance iron, have been disclosed in U.S. Pat. No. 4,036,638, issued July 19, 1977, as having improved mechanical thermal and magnetic properties over prior art glassy alloys. For example, these alloys evidence ultimate tensile strengths approaching 600,000 psi, hardness values approaching 1300 Kg/mm$^2$, crystallization temperatures (measured by differential thermal analysis) of about 475° C. (748° K.), room temperature saturation magnetizations of about 170 emu/g, coercivities of about 0.08 Oe and Curie temperatures of about 375° C. (648° K.).

Attempts have been made to increase the thermal stability of iron-boron glassy alloys without reducing the saturation magnetization. However, many elements which are found to increase the thermal stability, such as molybdenum, result in a substantial reduction in saturation magnetization, which may be unacceptable for some applications.

SUMMARY OF THE INVENTION

In accordance with the invention, introduction of beryllium into iron-boron base glassy alloys improves the thermal stability while substantially retaining the saturation magnetization of the base alloy. The alloys of the invention consist essentially of about 10 to 18 atom percent boron, about 2 to 10 atom percent beryllium and about 72 to 80 atom percent iron plus incidental impurities.

DETAILED DESCRIPTION OF THE INVENTION

Figure 1:
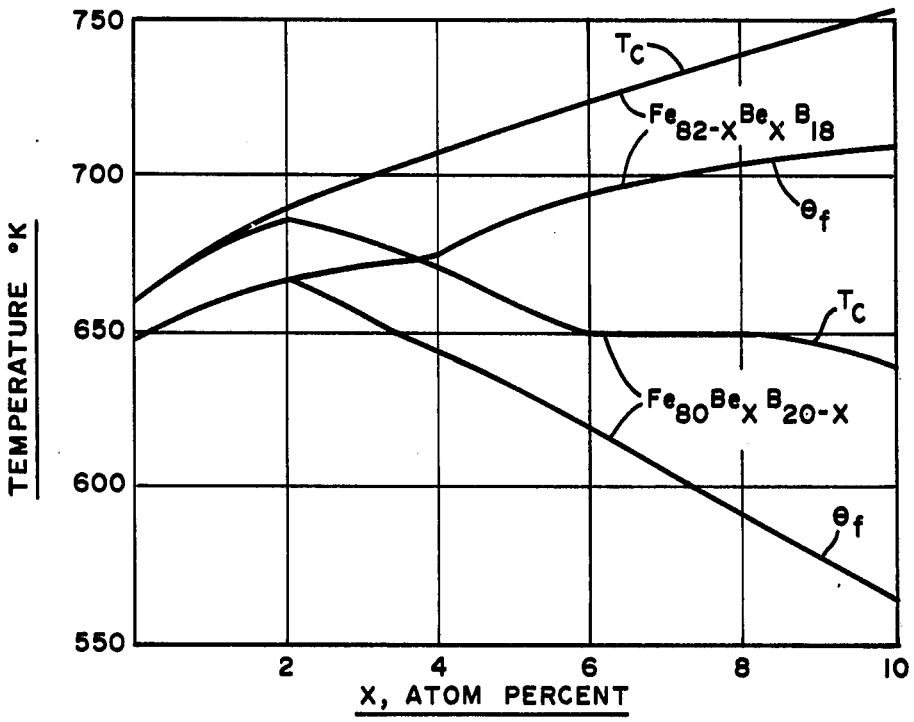
FIG. 1, on coordinates of temperature in ° K. and "x" in atom percent, depicts the change in Curie temperature ($\theta_f$) and crystallization temperature ($T_c$) for $Fe_{82-x}Be_xB_{18}$ and $Fe_{80}Be_xB_{20-x}$ series of glassy alloys.

The thermal stability of a glassy alloy is an important property in many applications. Thermal stability is characterized by the time-temperature transformation behavior of an alloy and may be determined in part by differential thermal analysis (DTA) or magnetic methods (e.g., magnetization as a function of temperature). As considered here, relative thermal stability is also indicated by the retention of ductility and bending after thermal treatment. Glassy alloys with similar crystallization behavior, as observed by DTA, may exhibit different embrittlement behavior upon exposure to the same heat treatment cycle. By DTA measurement, crystallization temperatures $T_c$ can be determined by slowly heating a glassy alloy (at about 20° to 50° K./min) and noting whether excess heat is evolved over a limited temperature range (crystallization temperature) or whether excess heat is absorbed over a particular temperature range (glass transition temperature). In particular, the glass transition temperature $T_g$ is near the lowest or first crystallization temperature $T_{cl}$ and, as is conventional, is the temperature at which the viscosity ranges from $10^{13}$ to $10^{14}$ poise.

Alternatively, magnetic methods may be used to determine $T_c$. For example, the transformation of glassy materials from glassy to crystalline states is accompanied by a rapid increase in magnetization. This transformation temperature is defined herein as the crystallization temperature $T_c$. Since $T_c$ depends on the heating rate, a low heating rate, typically about 120 K./min, is used to obtain $T_c$.

Typically, iron-boron glassy alloys evidence crystallization temperatures of about 600° to 690° K. (thermomagnetic measurements). The Curie temperature of these alloys is about 50° lower. It is desired to increase the crystallization temperature for two reasons. First, a higher crystallization temperature provides a higher service temperature for the alloy, since crystallization of a glassy alloy often results in a brittle product. Higher service temperatures are, of course, desired. Second, annealing a magnetic alloy often improves its magnetic properties, and to be fully effective, this annealing should be done at some temperature near or slightly above the Curie temperature and below the crystallization temperature of the glassy alloy. At temperatures above the Curie temperature, the glassy alloy is nonmagnetic. Thus, during cooling through the Curie temperature, magnetic anisotropy may be desirably induced in the glassy alloy. Of course, annealing at temperatures below the crystallization temperature avoids crystallization and possible embrittlement of the glassy alloy.

The glassy alloys of the invention consist essentially of about 10 to 18 atom percent (about 2.3 to 4.5 wt%) boron, about 2 to 10 atom percent (about 0.4 to 1.9 wt %) beryllium and about 72 to 80 atom percent (about 93.4 to 95.8 wt%) iron plus incidental impurities.

The purity of all materials used is that found in normal commercial practice. However, it is contemplated that minor amounts (up to a few atom percent) of other elements may be present, either from the primary elements or deliberately added, with only minor effect on properties. Such elements may be used to improve glass-forming behavior, for example. Elements especially contemplated include the transition elements (other than iron) of Groups IB to VIIB and VIII, Rows 4, 5 and 6 of the Periodic Table and the metalloid elements of carbon, silicon, aluminum and phosphorus.

The concentration of Be is constrained by two considerations. Addition of about 2 atom percent beryllium results in an increase of greater than 20° in both Curie and crystallization temperatures of the base iron-boron glassy alloy, while greater than about 10 atom percent beryllium results in formation of crystalline, rather than glassy, material.

A range of about 2 to 6 atom percent Be provides a combination of improved thermal stability, together with minimal reduction in saturation magnetization, and is accordingly preferred.

About 2 atom percent Be provides both the best combination of magnetic and thermal properties and is accordingly most preferred.

Most of the glassy alloys of the invention evidence both an increased Curie temperature and crystallization temperature over the base iron-boron alloy. Further, the glassy alloys of the invention evidence only a minimal reduction in saturation magnetization compared to the base alloy. For example, an alloy consisting essentially of 18 atom percent boron, 6 atom percent beryllium and the balance iron evidences a room temperature saturation magnetization of 156 emu/g, a Curie temperature of 695° K. and a crystallization temperature of 725° K., as compared with corresponding values of the base iron-boron alloy (18 atom percent boron, balance iron) of 171 emu/g, 647° K., respectively. Thus, a replacement of 6 atom percent iron with 6 atom percent beryllium results in a substantial improvement in thermal stability with a reduction of the saturation magnetization of only about 9%.

In contrast, substitution of 6 atom percent molybdenum for iron in a base alloy of 20 atom percent boron, balance iron, results in a 41% reduction in the saturation magnetization. Further, the Curie temperature is reduced by nearly 200° K., while the crystallization temperature is increased by nearly 100° K.

FIG. 1 depicts the variation in both Curie temperature ($\theta_f$) and crystallization temperature ($T_c$) for two series of glassy alloys, $Fe_{82-x}Be_xB_{18}$ and $Fe_{80}Be_xB_{20-x}$, as a function of "x". In the former series of glassy alloys, both temperatures are seen to increase with increasing values of "x". However, the crystallization temperature increases somewhat more rapidly than the Curie temperature. The increased difference at higher values of "x" provides greater ease in adjusting annealing temperatures so as to exceed the Curie temperature of the alloy without approaching too close to its crystallization temperature. In the latter series of glassy alloys in FIG. 1, both temperatures are seen to increase at first with increasing values of "x", then decrease at higher values of "x". Again, the increased difference between the Curie temperature and crystallization temperature at higher values of "x" provides greater ease in annealing the alloy.

Figure 2:
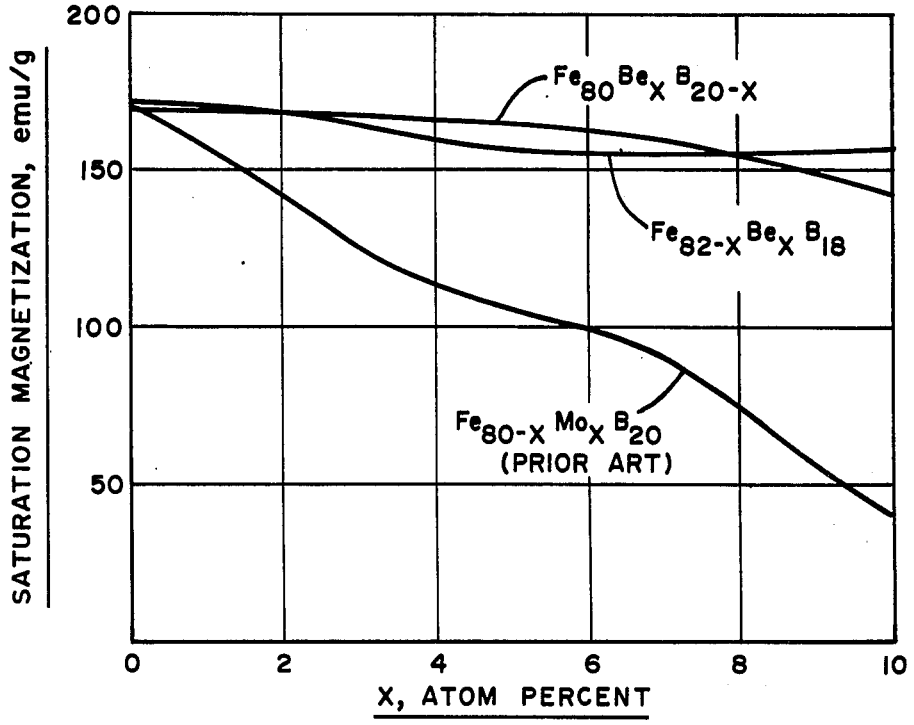
FIG. 2, on coordinates of saturation magnetization in emu/g and "x" in atom percent, depicts the change in saturation magnetization (room temperature) for $Fe_{82-x}Be_xB_{18}$ and $Fe_{80}Be_xB_{20-x}$ series of glassy alloys, compared with $Fe_{80-x}Mo_xB_{20}$ (prior art).

FIG. 2 depicts the variation in saturation magnetization for the two series of glassy alloys. The slight decrease with increasing values of "x" (less than about 9% for most values of "x") is considered to be minimal. In contrast, substitution of Mo for Fe in $Fe_{80-x}Mo_xB_{20}$ results in a substantial decrease in saturation magnetization, as shown in FIG. 2.

The glassy alloys of the invention are formed by cooling a melt of the requisite composition at a rate of at least about $10^5$° C./sec. A variety of techniques are available, as is now well-known in the art, for fabricating splat-quenched foils and rapid-quenched continuous ribbons, wire, sheet, etc. Typically, a particular composition is selected, powders of the requisite elements (or of materials that decompose to form the elements, such as ferroboron) in the desired proportions are melted and homogenized and the molten alloy is rapidly quenched either on a chilled surface, such as a rapidly rotating cooled cylinder, or in a suitable fluid medium, such as a chilled brine solution. The glassy alloys may be formed in air. However, superior mechanical properties are achieved by forming these glassy alloys in a partial vacuum with absolute pressure less than about 5 cm of Hg.

The glassy alloys of the invention are primarily glassy, and preferably substantially glassy, as measured by X-ray diffraction. Substantial glassiness results in improved ductility and accordingly such alloys are preferred.

EXAMPLES

Rapid melting and fabrication of glassy strips of ribbons of uniform width and thickness was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feed-through and placed in a stainless steel vacuum chamber. The vacuum chamber was a cylinder flanged at two ends with two side ports and was connected to a diffusion pumping system. The copper cylinder was rotated by variable speed electric motor via the feed-through. A crucible surrounded by an induction coil assembly was located above the rotating cylinder inside the chamber. An induction power supply was used to melt alloys contained in crucibles made of fused quartz. The glassy ribbons were prepared by melting the alloy in a suitable non-reacting crucible and ejecting the melt by over-pressure of argon through an orifice in the bottom of the crucible onto the surface of the rotating (about 3000 to 6000 ft/min surface speed) cylinder. The melting and squirting were carried out in a partial vacuum of about 2 cm using an inert gas such as argon to adjust the vacuum pressure. Using the vacuum melt casting apparatus described above, a number of glass-forming iron-boron alloys containing beryllium were chill cast as continuous ribbons having substantially uniform thickness and width. Typically, the thickness ranged from 35 to 50 μm and the width ranged from 2 to 3 mm. The ribbons were checked for glassiness by X-ray diffraction and DTA. Magnetic properties were measured with conventional DC hysteresis equipment and with a vibrating sample magnetometer. Curie and crystallization temperatures were determined by measuring the change in magnetization as a function of temperature (temperature increase at 1° K./min). The glassy ribbons were all ductile in the as-quenched condition.

1. Beryllium Substitution for Iron

Glassy alloys having a composition consisting essentially of 18 atom percent boron were fabricated as above in which beryllium content was varied from 2 to 10 atom percent and the balance (about 80 to 72 atom percent) was essentially iron. The measured saturation magnetization, Curie temperature and crystallization temperature of the various compositions are listed below in Table I.

TABLE I

Magnetic and Thermal Properties of Glassy $Fe_{82-x}Be_xB_{18}$

| x, atom percent | Saturation Magnetization (room temperature) | Curie Temperature, °K. | Crystallization Temperature, °K. |
|---|---|---|---|
| 0 | 171 | 647 | 658 |
| 2 | 168 | 668 | 690 |
| 4 | 159 | 676 | 706 |
| 6 | 156 | 695 | 725 |
| 8 | 156 | 705 | 740 |
| 10 | 158 | 710 | 752 |

2. Beryllium Substitution for Boron

Glassy alloys consisting essentially of 80 atom percent iron were fabricated as above in which beryllium was varied from 2 to 10 atom percent and the balance (about 18 to 10 atom percent) was essentially boron. The results of saturation magnetization, Curie temperature and crystallization temperature are listed below in Table II.

TABLE II

| | Magnetic and Thermal Properties of Glassy $Fe_{80}Be_xB_{20-x}$ | | |
|---|---|---|---|
| x, atom percent | Saturation Magnetization (room temperature) | Curie Temperature, °K. | Crystallization Temperature, °K. |
| 0 | 170 | 647 | 658 |
| 2 | 168 | 668 | 687 |
| 4 | 167 | 643 | 673 |
| 6 | 164 | 621 | 650 |
| 8 | 155 | 590 | 650 |
| 10 | 141 | 567 | 640 |

What is claimed is:

1. A beryllium-substituted, iron-boron, primarily glassy magnetic alloy consisting essentially of about 10 to 18 atom percent boron, about 2 to 10 atom percent beryllium and about 72 to 80 atom percent iron plus incidental impurities.

2. The alloy of claim 1 in which the beryllium content ranges from about 2 to 6 atom percent.

3. The alloy of claim 2 in which the beryllium content is about 2 atom percent.

4. The alloy of claim 1 consisting essentially of about 18 atom percent boron, 2 to 10 atom percent beryllium and about 80 to 72 atom percent iron plus incidental impurities.

5. The alloy of claim 1 consisting essentially of about 2 to 10 atom percent beryllium, about 18 to 10 atom percent boron and about 80 percent iron plus incidental impurities.

6. The alloy of claim 1 which is substantially glassy.

* * * * *

UNITED STATES PATENT AND TRADEMARK OFFICE

CERTIFICATE OF CORRECTION

PATENT NO. : 4,152,147

DATED : May 1, 1979

INVENTOR(S) : Ryusuke Hasegawa, Ranjan Ray and Lee E. Tanner

It is certified that error appears in the above-identified patent and that said Letters Patent are hereby corrected as shown below:

Col. 2, line 14, "120 K./min," should be --1° K/min,--

Col. 3, line 10, after "647° K." add --and 658° K. --

Signed and Sealed this

*Thirty-first* Day of *July 1979*

[SEAL]

*Attest:*

*Attesting Officer*

LUTRELLE F. PARKER

*Acting Commissioner of Patents and Trademarks*